US008363879B2

(12) United States Patent
Yamagishi

(10) Patent No.: US 8,363,879 B2
(45) Date of Patent: Jan. 29, 2013

(54) SPEAKER

(75) Inventor: Kiyoshi Yamagishi, Mie (JP)

(73) Assignee: Panasonic Corporation, Osaka (JP)

( * ) Notice: Subject to any disclaimer, the term of this patent is extended or adjusted under 35 U.S.C. 154(b) by 405 days.

(21) Appl. No.: 12/673,837

(22) PCT Filed: Jul. 23, 2008

(86) PCT No.: PCT/JP2008/001958
§ 371 (c)(1),
(2), (4) Date: Feb. 17, 2010

(87) PCT Pub. No.: WO2009/028132
PCT Pub. Date: Mar. 5, 2009

(65) Prior Publication Data

US 2011/0019864 A1 Jan. 27, 2011

(30) Foreign Application Priority Data

Aug. 29, 2007 (JP) ..... 2007-222403

(51) Int. Cl.
*H04R 9/06* (2006.01)

(52) U.S. Cl. ..... 381/412; 381/400

(58) Field of Classification Search ..... 381/400, 381/412, 182; 181/144
See application file for complete search history.

(56) References Cited

U.S. PATENT DOCUMENTS

| | | | | | |
|---|---|---|---|---|---|
| 4,554,414 | A * | 11/1985 | House | ..... | 381/182 |
| 4,590,332 | A * | 5/1986 | Delbuck | ..... | 381/397 |
| 5,512,714 | A * | 4/1996 | Fenton | ..... | 181/144 |
| 5,629,501 | A * | 5/1997 | Fenton | ..... | 181/144 |
| 5,635,686 | A * | 6/1997 | Fenton | ..... | 181/144 |
| 2003/0179899 | A1 * | 9/2003 | Welker et al. | ..... | 381/386 |
| 2004/0245042 | A1 * | 12/2004 | Nevill | ..... | 181/151 |
| 2005/0185816 | A1 * | 8/2005 | Roark et al. | ..... | 381/400 |
| 2006/0137935 | A1 * | 6/2006 | Nevill | ..... | 181/174 |

FOREIGN PATENT DOCUMENTS

| | | |
|---|---|---|
| EP | 1 771 035 A2 | 4/2007 |
| JP | 54-59827 | 4/1979 |
| JP | 63-52375 | 4/1988 |

OTHER PUBLICATIONS

International Search Report for International Application No. PCT/JP2008/001958, Sep. 2, 2008, Panasonic Corporation.

* cited by examiner

*Primary Examiner* — Yuwen Pan
*Assistant Examiner* — Phan Le
(74) *Attorney, Agent, or Firm* — RatnerPrestia

(57) ABSTRACT

A loudspeaker includes a frame coupled to a magnetic circuit, a cone diaphragm coupled to an outer periphery of the frame, a voice coil coupled to the cone diaphragm, the voice coil having a portion placed in a magnetic gap of the magnetic circuit, a tubular port having an end coupled to the voice coil, and a diameter of another end of the tubular port is larger than a diameter of a connecting portion at which the end of the tubular port is coupled to the voice coil, and a dome covering an upper end of the tubular port. A center axis of the tubular port inclines at least by 5° with respect to a center axis of the voice coil.

7 Claims, 3 Drawing Sheets

SPEAKER

This Application is a U.S. National Phase Application of PCT International Application PCT/JP2008/001958.

TECHNICAL FIELD

The invention relates to a loudspeaker to be used for various acoustic devices, particularly to a loudspeaker having an improved performance and sound quality.

BACKGROUND ART

FIG. 3 is a cross-sectional view of conventional example 1 of loudspeaker. This loudspeaker has a typical conventional structure, i.e., a single cone loudspeaker. As shown in FIG. 3, magnet 24 is bonded to yoke 25. Top plate 23 is bonded onto an upper surface of magnet 24. Yoke 25, magnet 24 and top plate 23 which are bonded to each other constitute magnetic circuit 22 having a magnetic gap having a cylindrical shape.

Magnetic circuit 22 is bonded to a lower surface of frame 21 made of resin. An outer periphery of cone diaphragm 28 is bonded to an outer periphery of frame 21. Voice coil 26 is bonded to a center part of cone diaphragm 28, and is placed in the magnetic gap formed in magnetic circuit 22. Damper 27 is bonded as to support voice coil 26. Dust cap 29 serving as a dustproof is placed at a center part of cone diaphragm 28

Patent Documents 1 and 2 are known as prior art documents related to the present invention.

This loudspeaker produces a phase difference between sounds generated at an inner part and an outer part of the cone diaphragm due to the difference between depths of these parts. The deeper is the cone diaphragm, the larger becomes the harmful influence, therefore deteriorating sound quality even if having preferable frequency characteristics.

FIG. 4 is a cross-sectional view of conventional example 2 of loudspeaker addressing this problem. In FIG. 4, components identical to those of conventional loudspeaker shown in FIG. 3 are denoted by the same reference numerals, and their detailed explanation will be omitted. This conventional speaker includes diffuser 30 attached to an upper surface of top plate 23. Diffuser 30 causes reflection and diffraction to shift the phase of the sound generated in the inner part of the cone diaphragm to that of the outer peripheral part.

However, conventional example 2 of loudspeaker which does not include a dust cap has a small vibrating area, thus reducing a sound pressure. Conventional example 2 of loudspeaker includes voice coil 26 having an upper part not sealed and reducing a dumping at low frequencies. In this loudspeaker, since a relative position between cone diaphragm 28 and diffuser 30 changes according to the amplitude of the sound, and may modulate phases.

FIG. 5 is a cross-sectional view of conventional example 3 of loudspeaker. In FIG. 5, components identical to those of conventional example 1 of loudspeaker shown in FIG. 3 are denoted by the same reference numerals, and their explanation will be omitted. Conventional example 3 of loudspeaker includes sub-cone 31 provided at an upper end of voice coil 26. Example 3 of loudspeaker causes reflection and diffraction, however, a concave space inside sub-cone 31 disturbs the phases, not improving the phase against the vibrating surface.

FIG. 6 is a cross-sectional view of a conventional example 4 of loudspeaker. Conventional example 4 of loudspeaker includes dust cap 42 fixed to an upper end of sub-cone 41 attached to the voice coil. This loudspeaker solves a part of the above mentioned problem. However, a sound generated by dust cap 42 and a sound generated by the sub-cone paper cause a phase interference with a difference in a distance between the dust cap and the cone paper, causing a large dip of a sound pressure at a certain frequency, still providing a problem.

Patent Document 1: JP63-52375U

Patent Document 2: EP1771035A

SUMMARY OF THE INVENTION

A loudspeaker includes a frame coupled to a magnetic circuit, a cone diaphragm coupled to an outer periphery of the frame, and a voice coil coupled to the cone diaphragm. A part of the cone diaphragm is placed in a magnetic gap of the magnetic circuit. The loudspeaker further includes a tubular port having an end coupled to the voice coil, and a dome covering an upper end of the tubular port. Another end of the tubular port has a diameter larger than a diameter of a connecting portion at which the port coupled is connected to the voice coil. A center axis of the tubular port inclines at least by 5° with respect to a center axis of the voice coil.

This structure improves a phase difference within the diaphragm and provides the loudspeaker with high sound quality.

REFERENCE NUMERALS

1 Frame
2 Magnetic Circuit
3 Top Plate
4 Magnet
5 Yoke
6 Voice Coil
6*a* Center Axis of Voice Coil 6
7 Damper
8 Cone Diaphragm
9 Tubular Port
9*a* Center Axis of Tubular Port 9
10 Dome
11 Sound Absorber
12 Connecting Portion

DETAILED DESCRIPTION OF PREFERRED EMBODIMENTS

Exemplary embodiments of the present invention will be described below with reference to the accompanied drawings.

Exemplary Embodiment 1

Figure 1:
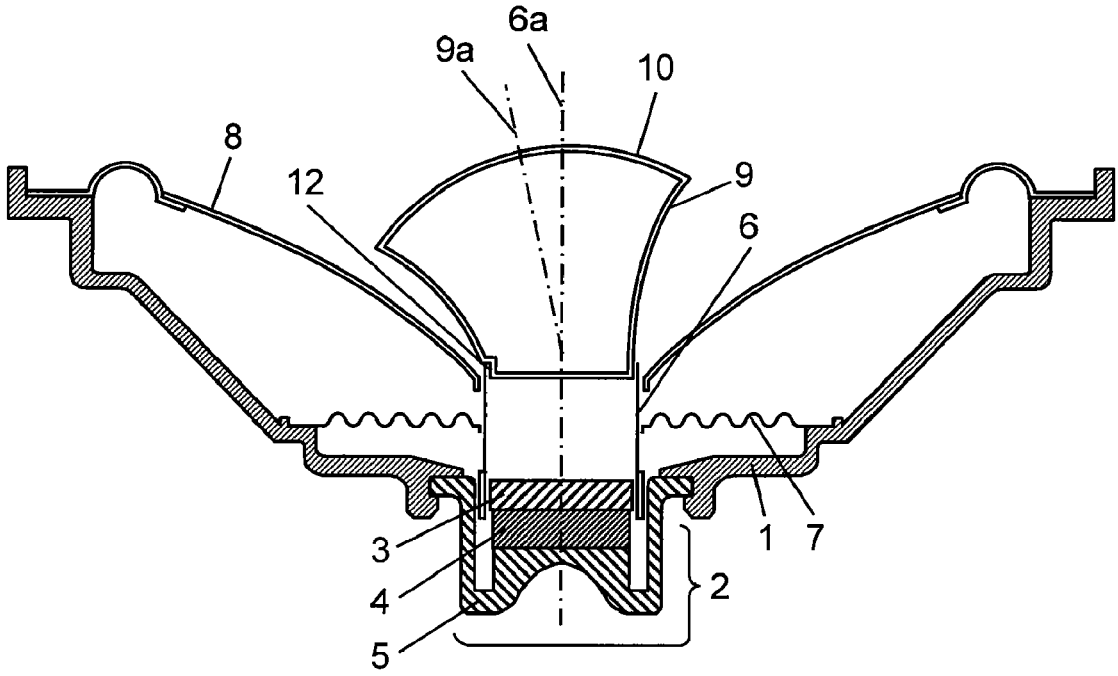
FIG. 1 is a cross-sectional view of a loudspeaker in accordance with Exemplary Embodiment 1 of the present invention.

FIG. 1 is a cross-sectional view of a loudspeaker in accordance with Exemplary Embodiment 1 of the present invention. The construction of the loudspeaker according to Embodiment 1 will be explained first with FIG. 1. As shown in FIG. 1, magnet 4 is bonded to yoke 5. Top plate 3 is bonded onto an upper surface of magnet 4. Yoke 5, magnet 4, and top plate 3 which are bonded to each other constitute magnetic circuit 2 having a magnetic gap having an annular shape. Magnetic circuit 2 is coupled to a lower surface of frame 1 made of resin. An outer periphery of cone diaphragm 8 is bonded to a periphery of frame 1. Voice coil 6 is coupled to the center of cone diaphragm 8 and placed in the magnetic gap formed in magnetic circuit 2. Damper 7 is bonded to voice coil 6 for supporting voice coil 6.

The loudspeaker according to Embodiment 1 has the following features. The loudspeaker according to Embodiment 1 includes frame 1 coupled to magnetic circuit 2, cone diaphragm 8 coupled to the outer periphery of frame 1, and voice coil 6 coupled to cone diaphragm 8 having a portion placed in the magnetic gap. The loudspeaker according to Embodiment 1 further includes tubular port 9 having an end coupled to voice coil 6, and dome 10 covering an upper end of tubular port 9. The diameter of another end of port 9 is larger than the diameter of connecting portion 12 at which the end of port 9 is coupled to voice coil 6. Center axis 9*a* of tubular port 9 inclines at least by 5° with respect to center axis 6*a* of voice coil 6.

In the loudspeaker according to Embodiment 1, a sound generated at an inner portion of cone diaphragm 8 is reflected and diffracted by tubular port 9 along dome 10, concentrates around dome 10 which functions as a virtual sound source. Thus, the position of the virtual sound source generating the sound is close to an outer part of cone diaphragm 8 generating a sound, reducing the phase difference between these sounds. A sound conventionally generated from a dust cap is generated from dome 10 through tubular port 9 of the loudspeaker according to Embodiment 1, so that the position of a sound source of the sound is close, thus aligning phases of the sounds entirely generated from the vibrating surface of the loudspeaker.

Dome 10 has a certain curvature diameter for securing an effective reflection and diffraction. In the loudspeaker according to this embodiment, the curvature diameter of the dome is larger than the diameter of voice coil 6. In other words, the diameter of the end of tubular port 9 coupled to dome 10 is larger than the diameter of connecting portion 12 at which the tubular port is connected to voice coil 6.

Figure 6:
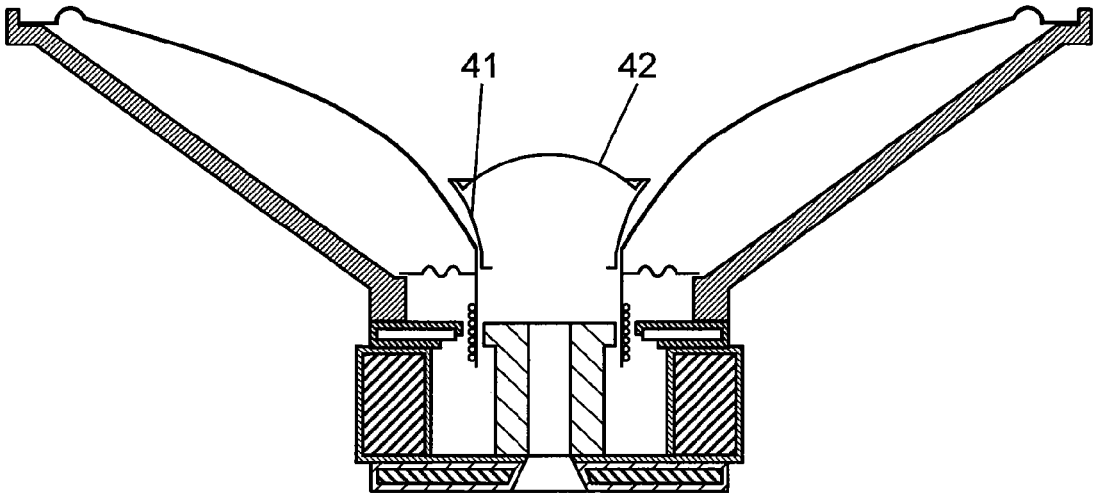
FIG. 6 is a cross-sectional view of conventional example 4 of loudspeaker.

Center axis 9*a* of tubular port 9 inclines with respect to center axis 6*a* of voice coil 6. In conventional example 4 shown in FIG. 6, a part of sound generated from an inner part of the cone diaphragm and a sound generated from dust cap 42 interfere and cancel each other due to the distance between the inner part of the cone diaphragm and the dust cap, thereby causing a large dip in a sound pressure at a certain frequency. In the loudspeaker according to Embodiment 1 shown in FIG. 1, since center axis 9*a* of tubular port 9 inclines, the distance between cone diaphragm 8 and dome 10 constantly changes in a circumferential direction, and prevents the interference from concentrating at a particular frequency, thus spreading the influence. This structure provides the loudspeaker according to Embodiment 1 with frequency characteristic flatter than that of conventional example 4. Center axis 9*a* of tubular port 9 inclines at least by an angle of 5° for providing effects. The angle is determined within a range preventing tubular port 9 from touching cone diaphragm 8.

For a listener positioned at a position deviating from center axis 6*a* of voice coil 6 of the loudspeaker according to Embodiment 1, acoustic characteristics changes according to the position in the circumferential direction of the diaphragm. However, it was confirmed that a sound quality was improved practically within a zone ranging at about ±90° with respect to center axis 9*a* of tubular port 9.

As shown in FIG. 1, dome 10 has a partially spherical shape, and may have almost a whole spherical shape for modifying the acoustic characteristics. However, as the shape of the dome becomes closer to the perfect spherical shape, the dome accordingly protrudes from cone diaphragm 8, to which may be pay attention if the loudspeaker is mounted to a vehicle.

Tubular port 9 and dome 10 are unitarily molded, but may be formed by producing the tubular port and the dome as separate components and bonding them. Tubular port 9 and dome 10 may be made of pulp paper, molded cloth, resin, film or metal foil.

Exemplary Embodiment 2

Figure 2:
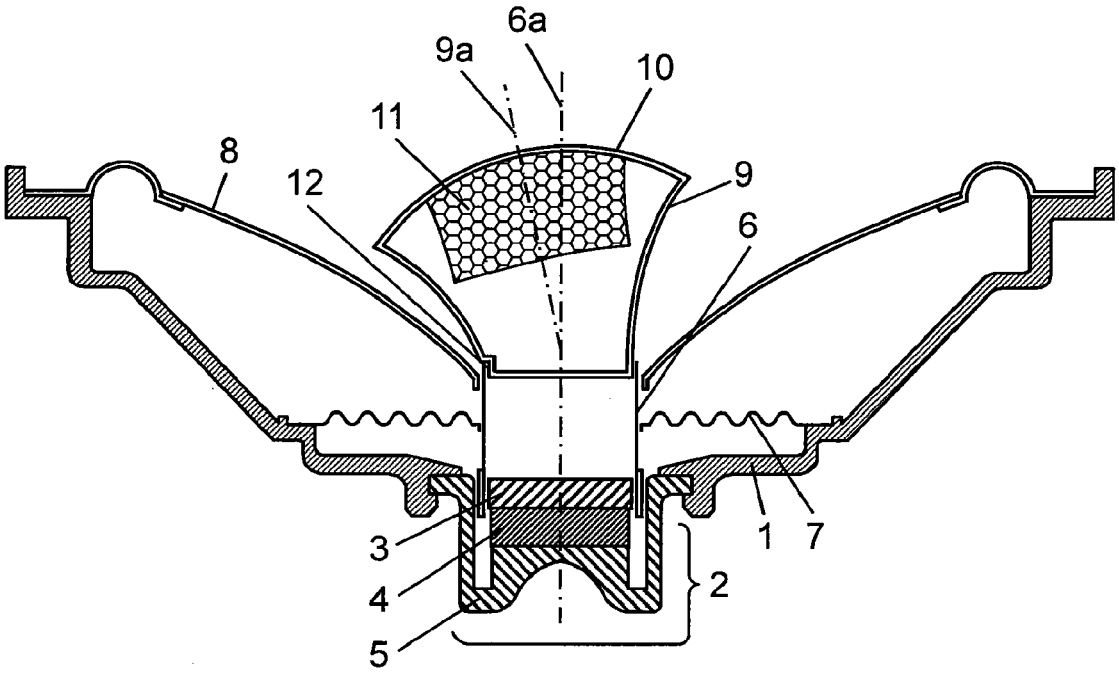
FIG. 2 is a cross-sectional view of a loudspeaker in accordance with Exemplary Embodiment 2 of the invention.
Figure 3:
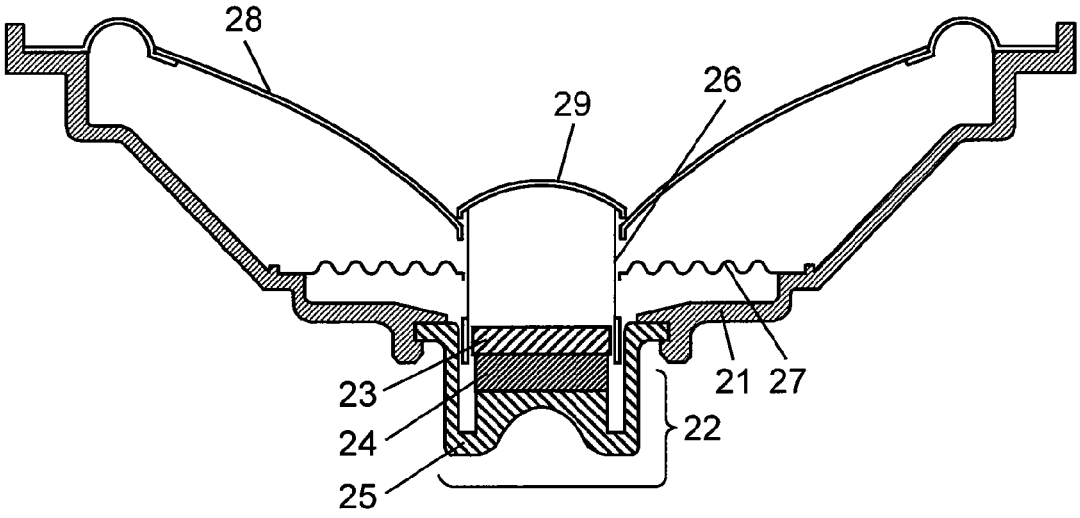
FIG. 3 is a cross-sectional view of conventional example 1 of loudspeaker.
Figure 4:
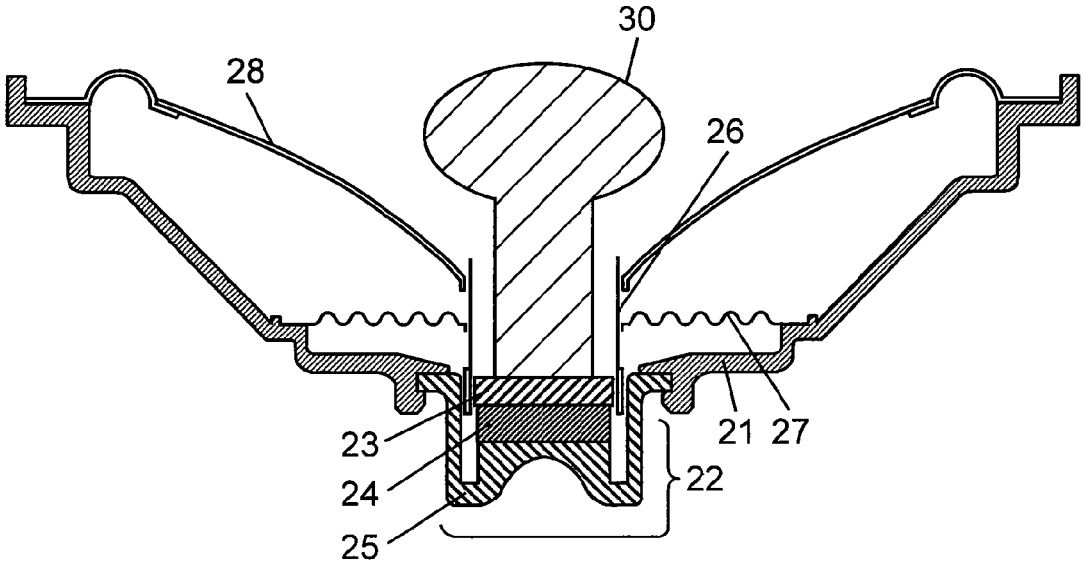
FIG. 4 is a cross-sectional view of conventional example 2 of loudspeaker.
Figure 5:
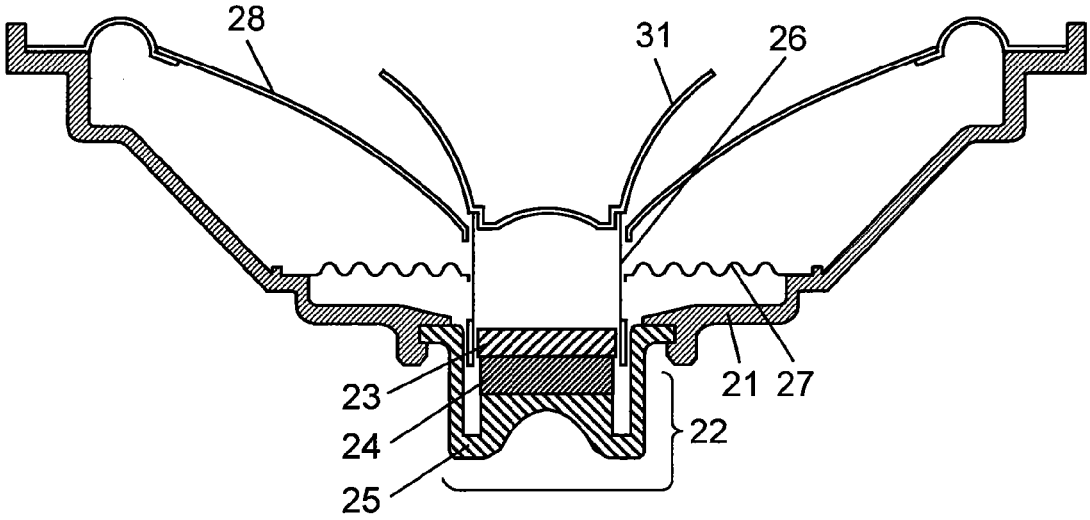
FIG. 5 is a cross-sectional view of conventional example 3 of loudspeaker.

FIG. 2 is a cross-sectional view of a loudspeaker in accordance with Exemplary Embodiment 2 of the invention. In FIG. 2, components identical to whose of conventional example 1 shown in FIG. 3 are denoted by the same reference numerals, and their description will be omitted. A difference of the loudspeaker according to Embodiment 2 from the loudspeaker according to Embodiment 1 is that sound absorber 11 is placed in a space surrounded by tubular port 9 and dome 10. The sound absorber absorbs a resonance sound generated by tubular port 9, dome 10, and the internal space surrounded by the port and dome as to adjust sound quality.

As shown in FIG. 2, sound absorber 11 is made of porous material. The absorber is fixed to dome 10, but may be fixed to tubular port 9 when necessary, or may fill the whole internal space. The sound absorber may be made of fibrous material instead of the porous material.

Exemplary Embodiment 3

A difference of a loud speaker according to Embodiment 3 from the loudspeakers according to Embodiment 1 and 2 is that a total mass of dome 10, tubular port 9, and a portion surrounded by the port and dome is close to an effective mass of cone diaphragm 8. This structure balances a mass of an inner part of voice coil 6 with a mass of an outer part of the voice coil, and allows piston motion of the voice coil in a wider frequency range, thereby improving sound quality. According to experiments, the difference between the total mass and the effective mass was preferably smaller than 40% as to improve sound quality.

INDUSTRIAL APPLICABILITY

A loudspeaker according to the present invention is applicable to an acoustic devices and automotive devices requiring high sound quality.

The invention claimed is:

1. A loudspeaker comprising:

a frame coupled to a magnetic circuit;

a cone diaphragm coupled to an outer periphery of the frame;

a voice coil coupled to the cone diaphragm, the voice coil having a portion placed in a magnetic gap of the magnetic circuit;

a tubular port having a first end and a second end, the first end being coupled to the voice coil; and a dome covering the second end of the tubular port, the dome having an outer periphery coupled to the second end of the tubular port, wherein a diameter of the second end of the tubular port is larger than a diameter of the first end of the tubular port, and a center axis of the tubular port inclines at least by 5° with respect to a center axis of the voice coil.

2. The loudspeaker according to claim 1, further comprising a sound absorber placed in a space surrounded by the tubular port and the dome.

3. The loudspeaker according to claim 1, wherein a difference between a total mass of the tubular port, the dome, and a portion included in the port and dome and an effective mass of the cone diaphragm is less than 40%.

4. The loudspeaker according to claim 2, wherein a difference between an effective mass of the cone diaphragm and a total mass of the tubular port, the dome, and a portion surrounded by the tubular port and the dome is less than 40%.

5. The loudspeaker according to claim 1, wherein a distance between the cone diaphragm and the dome changes in a circumferential direction of the cone diaphragm.

6. The loudspeaker according to claim 1, wherein the dome and the cone diaphragm are driven by the voice coil to generate a sound.

7. The loudspeaker according to claim 1, wherein the dome protrudes away from the voice coil.

* * * * *